United States Patent [19]

Moore

[11] 4,453,351

[45] Jun. 12, 1984

[54] ENCLOSED STRUCTURE

[76] Inventor: John V. Moore, 702/22 Doris St., North Sydney, N.S.W., Australia

[21] Appl. No.: 302,413

[22] PCT Filed: Jan. 15, 1981

[86] PCT No.: PCT/AU81/00006

§ 371 Date: Sep. 10, 1981

§ 102(e) Date: Sep. 10, 1981

[87] PCT Pub. No.: WO81/02035

PCT Pub. Date: Jul. 23, 1981

[30] Foreign Application Priority Data

Jan. 15, 1980 [AU] Australia ..... PE2016

[51] Int. Cl.[3] ..... E04H 7/00

[52] U.S. Cl. ..... 52/82; 52/192; 52/245

[58] Field of Search ..... 52/82, 245–249, 52/192

[56] References Cited

U.S. PATENT DOCUMENTS

| | | | |
|---|---|---|---|
| 1,073,871 | 9/1913 | Stillman | 52/82 |
| 2,323,297 | 7/1943 | Collins | 52/248 |
| 2,955,686 | 10/1960 | Blomeley | 52/246 |
| 2,983,340 | 5/1961 | Zittle | 52/245 |
| 4,227,353 | 10/1980 | Lewis | 52/82 |

FOREIGN PATENT DOCUMENTS

| | | | |
|---|---|---|---|
| 35268 | 3/1950 | Poland | 52/245 |
| 365907 | 1/1963 | Switzerland | 52/245 |
| 668134 | 3/1952 | United Kingdom | 52/245 |
| 761775 | 11/1956 | United Kingdom | 52/245 |
| 858150 | 1/1961 | United Kingdom | 52/82 |
| 1207966 | 10/1967 | United Kingdom | 52/245 |

*Primary Examiner*—Henry E. Raduazo

*Attorney, Agent, or Firm*—Cushman, Darby & Cushman

[57] ABSTRACT

An enclosed structure such as a silo, particularly suitable for containing grain crops, is provided.

The structure has a series of vertical posts disposed in a circle. A series of horizontal girts are attached to the inside of the posts. The inside surface defined by the girts is clad with lightweight sheet material. A roof is added and the structure may be sealed.

5 Claims, 3 Drawing Figures

ENCLOSED STRUCTURE

Field of the Invention

This invention relates to an enclosed structure and has been devised particularly, though not solely, as a grain silo.

Background Art

Most silos and containers or storage bins for large amounts of particulate solids, are made from reinforced concrete or heavy steel plate. Such constructions require skilled engineering and manpower to erect. They are also very costly to build.

Summary of the Invention

It is desirable to provide an enclosed structure which may be used as a grain silo and which is simple and cheap to construct to enable grain to be simply and cheaply stored at a desired location.

It is therefore an object of the present invention to provide an enclosed structure which will go at least part of the way towards meeting the foregoing desiderata in a simple yet effective manner, or which will at least provide the public with a useful choice.

Accordingly, in one aspect the invention may broadly be said to consist in an enclosed structure suitable for containing particulate solids characterized by a plurality of posts set on foundations so as to define the line of a cornerless wall, a plurality of rafters extending upwardly and inwardly from each said post to a central point or ridge, a plurality of circumferential girts extending substantially horizontally between said posts along the line of said wall, sheet wall cladding extending the height of said wall fastened to said girts, the vertical edges of the adjoining sheets of cladding being secured together in a structural manner, and roof cladding placed over said rafters form a roof.

Preferably, the cladding is of corrugated or ribbed cross-section sheet metal, although many non-metallic materials would also be suitable.

This mode of construction utilises girts to carry the majority of the stresses imposed by the particulate solids contained therein. The internal cladding does not carry high loadings over large spans as the girts are placed sufficiently close together to spread the load. Thus the thickness of the sheet cladding used is very much reduced from that used in conventional silos.

The girts are preferably angle or T-section steel members spaced at suitable distances generally from 100 mm to 900 mm. The girts are attached to the posts and the internal cladding attached to the girts. The joins of adjacent sheets of cladding are preferably sealed with a flexible sealing compound.

The sheets of cladding are preferably oriented with their ribs or corrugations disposed in the vertical direction.

The technique of building a silo in accordance with the invention enables silos capable of holding up to 35,000 kg to be readily constructed. As the silo is filled there is slight expansion of the walls. This expansion creates a significant problem if the bottom edge of the cladding is merely directly secured to the foundations as it will be sheered open or will crack after a number of loadings.

To overcome this problem the invention provides a lower circumferential wall of heavier gauge sheet steel secured at its lower end to the foundations and at its upper end to the sheet metal cladding. There is no need, in general, to have girts around this lower wall if it is made of sufficiently thick metal. Thus when the silo is loaded the upper end of the lower wall can expand with the sheet metal cladding, whilst the lower end remains fixed. The lower wall is preferably about two meters high although obviously it could range from 1 meter to, say, 4 meters depending on the size of the silo being constructed.

The lower wall is preferably formed from a series of plates which are joined along their vertical intersection.

In order to construct silos in accordance with this invention a very simple procedure is followed.

The floor and foundations of the silo are prepared. The floor will generally include one or more conveyor or screw type solids removal units therein. The posts are erected by a crane and secured to the foundations, by say four bolts. The posts will generally define a circular area. The girts are attached to the inside of the posts. The bottom wall section is erected. The main sheet cladding walls are secured to the girts. The roof rafters and cladding are finally added.

Where the container (silo) is to be used for longer term storage of degradable materials, such as grain crops, it is desirable to seal the roof to the walls so that the silo may be filled with a suitable gas to prevent such degradation. To achieve this, a foil-type membrane may be laid, say, under or on top of the roof rafters and attached to the top of the walls.

In a further aspect the invention may broadly be said to consist in a silo air space bag, comprising an enclosed bag of flexible material adapted to be inserted into the air space of a grain silo between the grain and the roof of the silo and a connecting conduit between the interior of said bag and the atmosphere.

The air bag allows for expansion and contraction of the gas within the silo due to temperature effects, to be accommodated. This is achieved by expelling air from the bag to the atmosphere or drawing air into the bag from the atmosphere. This allows a sealed silo filled with an expensive gas to be stablised over a long period without the need to have a continual gas bleed or recharge.

There is thus provided a structure which is inexpensive, lightweight, sealable and of exceptionally strong construction. The structure can be readily constructed by unskilled labour with a minimum of supervision without the need for exotic equipment or techniques.

Notwithstanding any other forms that may fall within its scope one preferred form of the present invention will now be described by way of example only with reference to the accompanying drawings, in which:

Figures of the Drawings

Description of the Preferred Embodiment

In the preferred form of the invention an enclosed structure, particularly suitable for use as a grain silo, is constructed as follows.

A plurality of vertical posts 11 are provided set on foundations 12 so as to define the line of a cornerless wall. In the preferred form of the invention shown in the accompanying drawings, 8 vertical posts are provided set so as to define a circular wall.

The upper ends of the posts are arranged to support roof rafters 13 which if necessary may be trusses (not shown), which extend inwardly and upwardly from the posts to be a central receiving member point 14. The posts 11 and rafters 13 may, for example, be universal beams, alternatively the rafters 13 may be fabricated by welding from metal sections.

Figure 3:
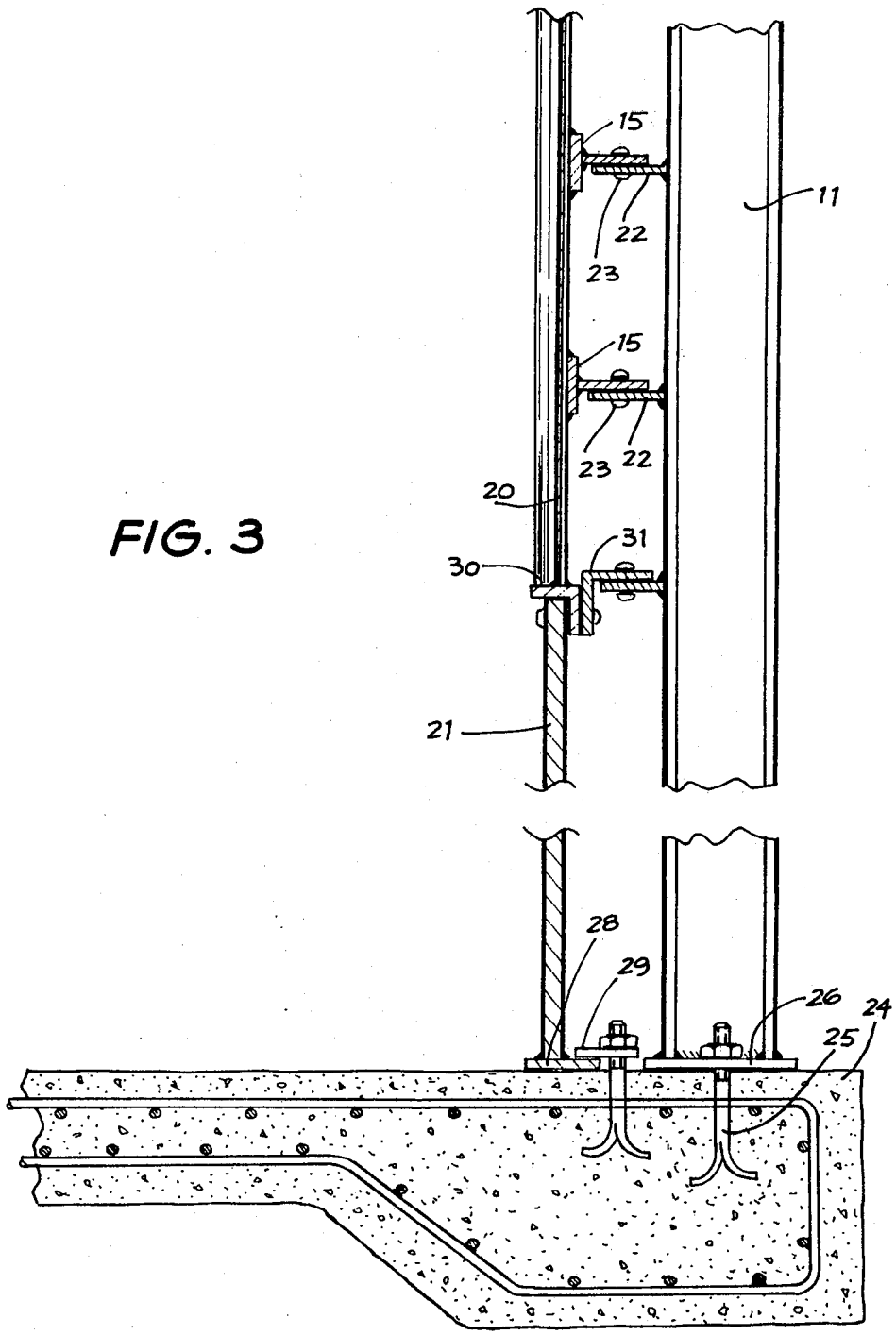
FIG. 3 is a view of section 3-3 of FIG. 1.

The vertical posts 11 are interconnected by a plurality of horizontal circumferential girts 15 which may for example be formed from angle iron or T-section as shown in cross section at 15 in FIG. 3. The girts 15 form continuous circumferential hoops around the line of the posts 11. The girts may be attached to the posts 11 by rivetting 23 onto a flange 22 extending from the posts 11.

The roof framing of the embodiment shown in the accompanying drawings consist of a series of intersecting radial rafters which, in turn, support purlins 40.

Figure 1:
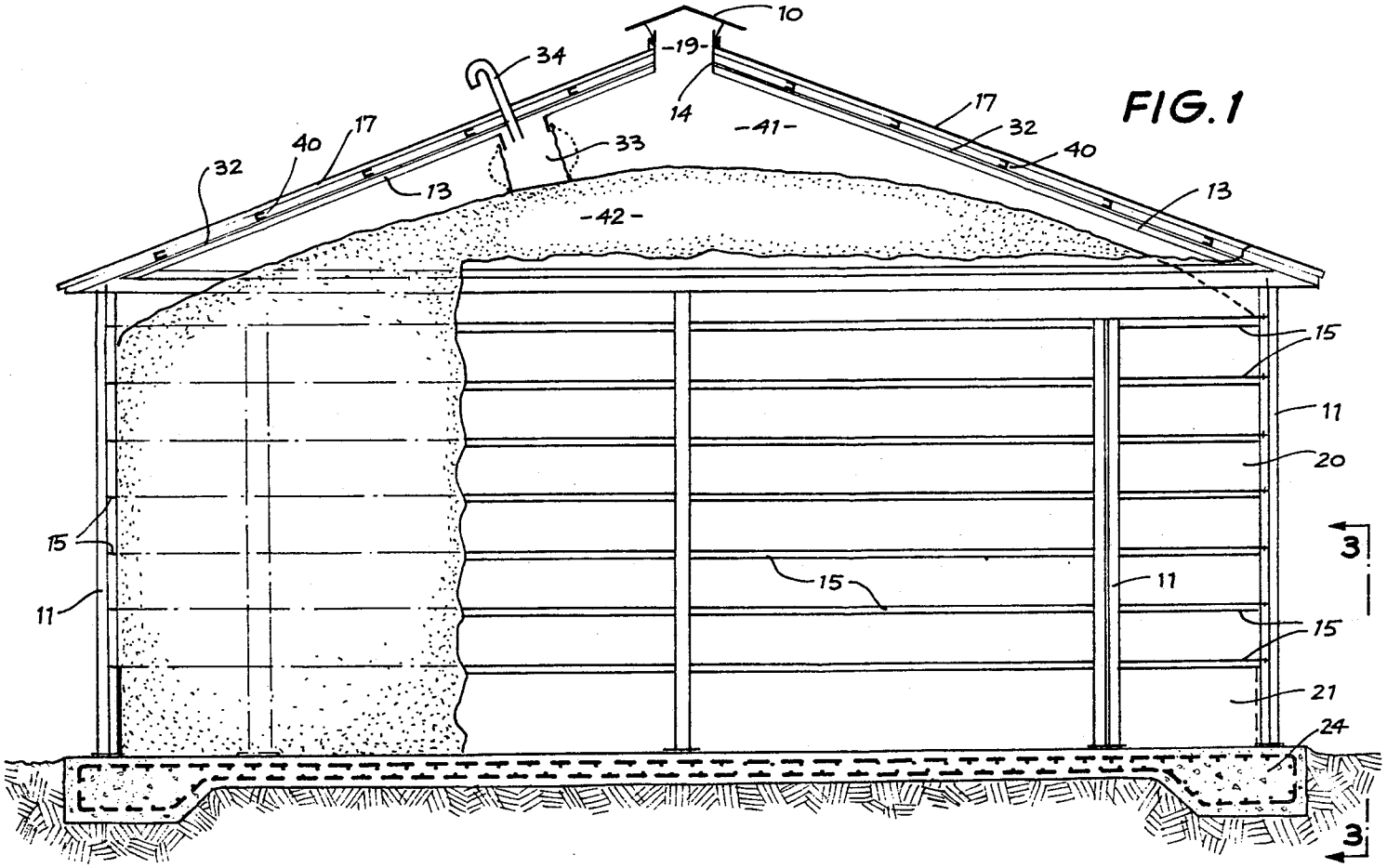
FIG. 1 is a cross sectional elevation of an enclosed structure according to the invention.
Figure 2:
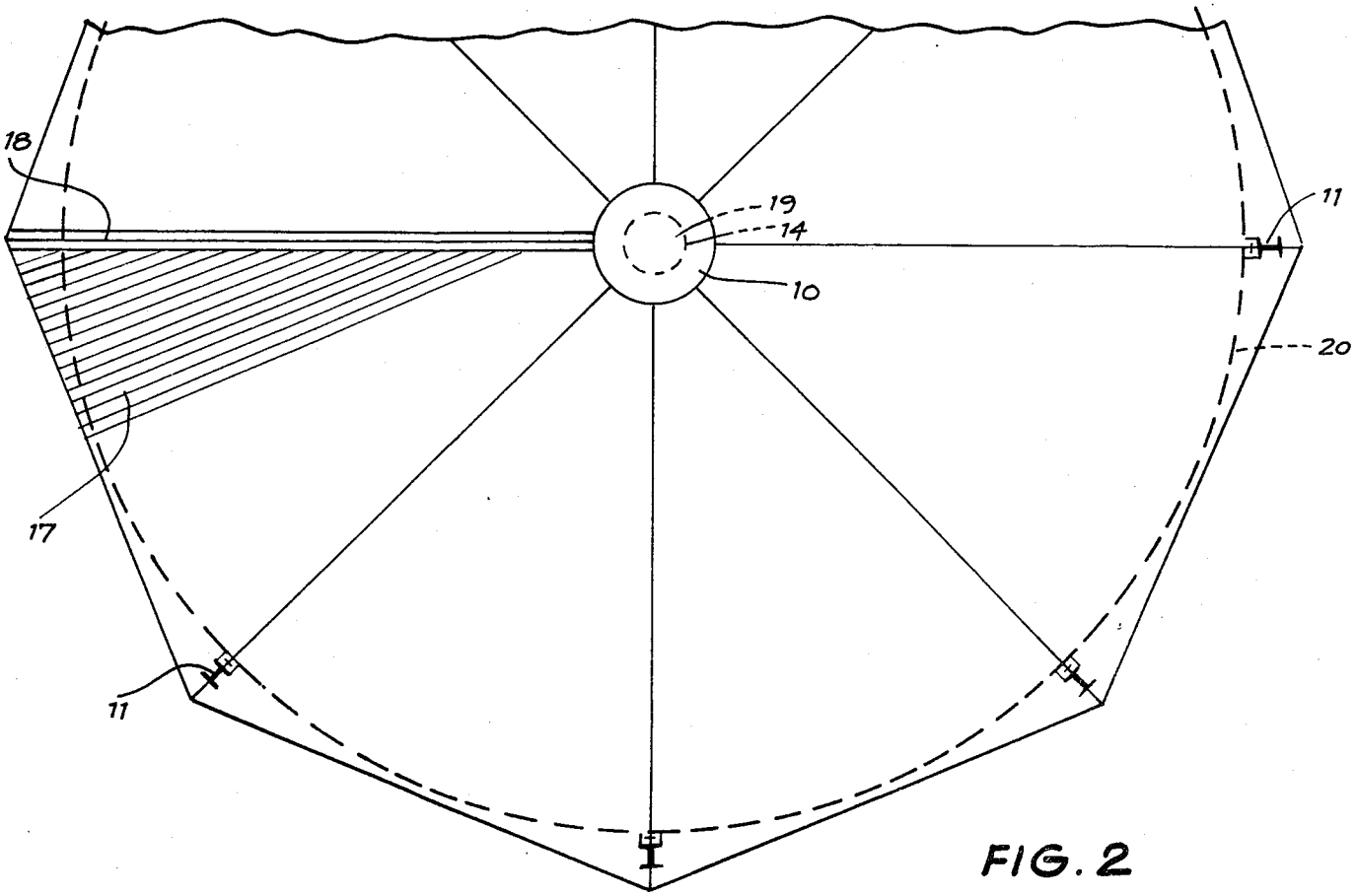
FIG. 2 is a diagrammatic partially cut-away view of the structure shown in FIG. 1.

The roof is covered with sheet cladding material shown at 17 in FIG. 2 which is joined on the line of the main trusses 13 by a ridge cap 18. The peak of the roof is provided with an opening 19 provided with a removable covering 10 to allow the silo to be filled with grain.

The walls of the silo are clad with corrugated sheet wall cladding 20 extending the height of the wall and fastened to the girts 15, for example by rivetting or bolting. The vertical edges of adjoining sheets of cladding 20 are lapped, sealed and secured together in a structural manner, for example by a line of mastic compound, and fastening with heavy gauge rivets so that the sheet becomes one homogeneous structural element.

There is also in the roof system a tie member near the eaves which attaches to the posts 11 to act both in tension and compression and completes a structural system of exceptional strength and lightness since it embodies a skin membrane construction and provides a monolithic structure.

The girts 15 which support the wall sheeting 20 are of sufficient strength to resist wind loads on the whole structure and keep the building stable and at the same time provide necessary strength to cater for internal pressures due to the grain load.

The lower part of the container wall (see FIG. 3) is formed from heavier gauge steel plates 21 joined together at their vertical intersection by means of overlapping plates (not shown).

The bottom edge of the plates 21 have a horizontal flange 28 which is fixed to the floor 30 or foundations 24 of the structure by bolts 27 which secure an overlying plate 29 on the flange 28.

The upper edge of the plates 21 are attached to a pair of angle members 30, 31 which provide a suitable seat for the base of the corrugated cladding 20. The seat formed by members 30 and 31 provides a vertical and horizontal resistance to the outward forces on the bottom of the cladding 20. The member 31 is attached to a flange 22 protruding from the post 11.

In FIG. 3 the cladding 20 is illustrated showing the depth of a typical corrugation.

The construction of the wall as shown in FIG. 3 allows for the outwards deflection of the wall at the intersection of the cladding 20 with the wall section 21 without damage to the bottom of the cladding 20.

There are two major aspects for applications of the design of the enclosed structure. The first is for a silo which would be built as part of a grain storage system. It would be a single purpose building for storing grain. The second application is one for a smaller silo which might be built on a farm and would have incorporated in the design doors so that the silo would become a multi-purpose building suitable for recreation or storage of machinery when not in use as a silo. In the first application one of the improved features will be the sealability of the structure. To achieve sealability a special sealing member 32 is introduced in the plane of the under side of the roof sheeting 17. To this sealing member 32 will be attached flashing and sealing materials so as to enable the structure to be rendered airtight and so make it suitable for fumigating the contents of the silo.

Another feature of this application is the introduction of a "balloon" or breather bag 33 in the air space under the roof. This bag is connected to the atmosphere by means of a breather tube 34 so that as diurnal temperature affects the gas in the head space 41 above the stored grain 42, gases are not expelled from the structure during the day due to heating of the gas, or diluted by air as the gases cool down during the night. Instead, air is expelled from the balloon 33 during the day and drawn into the balloon during the night so that the expensive gases which are used for fumigation remain intact and do not require expensive topping up.

In this manner an enclosed structure is provided which is particularly suitable for the storage of grain in a simple and yet effective manner and which may also be used as a farm building by replacing one section of the wall between adjacent posts by suitable doors.

I claim:

1. A structure having a roof and corner-less side wall encompassing a space to receive particulate solids, said structure comprising:

a foundation, a frame fixed to the foundation so as to be supported thereby, said frame including a plurality of generally upwardly extending posts fixed at their lower ends to said foundation and arranged in spaced relationship so as to generally define the position of said wall, a plurality of girts extending generally horizontally between said posts;

cladding located internally of and fixed to said frame so as to provide said wall, said cladding including first cladding sheets extending horizontally around the entire wall to provide a lower wall portion, said lower wall portion being fixed to said foundation so as to extend upwardly therefrom to a predetermined height and having sufficient rigidity to withstand pressures to be applied thereto by said particulate solids and second cladding sheets in the form of vertically corrugated sheets extending horizontally around the entire wall so as to provide an upper wall portion, said upper wall portion being fixed to said lower wall portion so as to extend upwardly therefrom and being fixed to said girts so as to be supported thereby.

2. The structure of claim 1 wherein said roof includes a plurality of rafters which extend from said posts to a peak, and further cladding sheets fixed to said rafters, and wherein the cladding sheets of the wall and roof are all joined so that said space is enclosed by said side wall and roof.

3. The structure of claim 2 further including pressure compensation means located within said space and communicating with the atmosphere exterior of said structure so as to compensate for pressure variations within said structure.

4. The structure of claim 3 wherein said pressure compensation means is a sealed bag communicating with the atmosphere exterior of said structure by means of a conduit.

5. The structure of claim 1, wherein said girts are located on the inside of said posts and the cladding forming said side wall is spaced from said posts toward the interior of said structure.

* * * * *